US010531722B2

(12) United States Patent
Kukreja

(10) Patent No.: US 10,531,722 B2
(45) Date of Patent: Jan. 14, 2020

(54) ADJUSTABLE APPLICATOR

(71) Applicant: HCT PACKAGING, INC., Bridgewater, NJ (US)

(72) Inventor: Shipra Kukreja, New Delhi (IN)

(73) Assignee: HCT PACKAGING, INC., Bridgewater, NJ (US)

( * ) Notice: Subject to any disclaimer, the term of this patent is extended or adjusted under 35 U.S.C. 154(b) by 94 days.

(21) Appl. No.: 15/897,482

(22) Filed: Feb. 15, 2018

(65) Prior Publication Data

US 2018/0228270 A1 Aug. 16, 2018

(30) Foreign Application Priority Data

Feb. 16, 2017 (IN) ..... 201711005605

(51) Int. Cl.

| | |
|---|---|
| ***A45D 40/26*** | (2006.01) |
| ***A46B 5/00*** | (2006.01) |
| ***A46B 15/00*** | (2006.01) |
| ***A46B 9/02*** | (2006.01) |
| ***A46B 7/02*** | (2006.01) |

(52) U.S. Cl.

CPC ..... *A45D 40/265* (2013.01); *A46B 5/0033* (2013.01); *A46B 7/023* (2013.01); *A46B 9/021* (2013.01); *A46B 15/0095* (2013.01); *A45D 2200/10* (2013.01)

(58) Field of Classification Search

CPC ..... A46B 5/0033; A46B 7/02; A46B 7/023; A46B 7/026; A46B 7/264; A46B 7/267; A46B 7/268; A46B 15/0095; A46B 9/021; A45D 40/265

See application file for complete search history.

(56) References Cited

U.S. PATENT DOCUMENTS

| | | | |
|---|---|---|---|
| 715,881 | A | 12/1902 | Scott |
| 783,937 | A | 2/1905 | Edwards et al. |
| 987,277 | A | 3/1911 | Wright |

(Continued)

FOREIGN PATENT DOCUMENTS

| | | | |
|---|---|---|---|
| CN | 1196212 | A | 10/1998 |
| CN | 201734124 | U | 2/2011 |
| CN | 201734141 | U | 2/2011 |
| CN | 201929278 | U | 8/2011 |
| CN | 302655796 | S | 11/2013 |
| CN | 302667633 | S | 12/2013 |
| CN | 303098564 | S | 2/2015 |

(Continued)

OTHER PUBLICATIONS

All for One, Full Magnetic Travel Brush Set, Sephora, retrieved on Feb. 26, 2015 at <>, 3 pages.

(Continued)

*Primary Examiner* — David J Walczak
*Assistant Examiner* — Randall A Gruby
(74) *Attorney, Agent, or Firm* — Seager, Tufte & Wickhem LLP

(57) ABSTRACT

An adjustable applicator including an application member and an actuator. The application member comprises a flexible support and a plurality of application elements on its surface. The application member has one free end and one fixed end. The fixed end is fixedly connected to a stem. The free end of the application member is connected to a distal end of the transmission member. The actuator is actuated for moving the transmission member along a longitudinal axis of the adjustable applicator to cause progressive modification in shape of the application member.

9 Claims, 7 Drawing Sheets

(56) References Cited

U.S. PATENT DOCUMENTS 1,030,440 A 6/1912 Jvaterman
1,065,879 A 6/1913 Krebs
1,067,596 A 7/1913 Fesler
1,112,193 A 9/1914 Carleton et al.
1,142,698 A 6/1915 Grove et al.
1,170,923 A 2/1916 Malkin
1,185,617 A 6/1916 Blaha et al.
1,188,214 A 6/1916 Sohn
1,190,227 A 7/1916 Fesler
D51,319 S 10/1917 Montgomery
1,261,502 A 4/1918 Farrows
1,274,697 A 8/1918 Dynowsky
1,355,026 A 10/1920 Austin
1,358,597 A 11/1920 Tobias
1,429,823 A 9/1922 Allison
1,457,615 A 6/1923 Bunker
1,506,292 A 8/1924 Corsello
1,510,898 A 10/1924 Nikicser
1,563,031 A 11/1925 Jones
1,626,992 A 5/1927 Willk
1,639,388 A 8/1927 Stebbings
1,651,355 A 12/1927 Alland
1,659,800 A 2/1928 Bailey
1,831,393 A 11/1931 Pierce, Jr.
1,889,496 A 11/1932 Priest
2,104,651 A 1/1938 Hoffman, Jr.
2,132,943 A 10/1938 Frazier
D134,797 S 1/1943 Lubkin
2,321,265 A 6/1943 Ulvick
2,442,051 A 5/1948 Luscri
2,485,822 A 10/1949 Goldrich
2,591,537 A 4/1952 Gordon
2,637,060 A 5/1953 Cowan
2,637,868 A 5/1953 Hamilton
2,697,642 A 12/1954 Rudy
2,701,378 A 2/1955 Reinbolt et al.
2,736,051 A 2/1956 Boodakian
2,825,080 A 3/1958 Bongiovanni
2,866,993 A 1/1959 Edelstone
2,874,399 A 2/1959 Solomon
2,946,072 A 7/1960 Filler et al.
2,982,983 A 5/1961 Peterson
3,007,188 A 11/1961 Dolan
3,106,738 A 10/1963 Bohne
3,193,863 A 7/1965 Myers et al.
3,205,523 A 9/1965 Seaver
D204,449 S 4/1966 Zavodsky
3,309,728 A 3/1967 Seaver
3,592,202 A 7/1971 Jones
3,863,288 A 2/1975 Aversa
3,908,676 A 9/1975 Levine et al.
D245,462 S 8/1977 Hauf
4,088,413 A 5/1978 Rossignol de la Ronde et al.
D249,600 S 9/1978 Bowman
4,129,918 A 12/1978 Lee et al.
4,165,755 A 8/1979 Cassai
4,204,294 A 5/1980 Halverson
D258,241 S 2/1981 Takada et al.
4,248,543 A 2/1981 Carrington et al.
4,428,388 A 1/1984 Cassai et al.
4,446,880 A * 5/1984 Gueret ..... A45D 40/265 132/218
4,483,036 A 11/1984 Sayklay
4,502,497 A 3/1985 Siahou et al.
D278,951 S 5/1985 Kalinsky
4,545,393 A * 10/1985 Gueret ..... A45D 40/265 132/218
4,600,328 A 7/1986 Clements
4,727,618 A 3/1988 Mahoney et al.
D297,889 S 10/1988 Ries et al.
4,869,612 A * 9/1989 Mooney ..... A45D 34/04 401/130
4,898,193 A 2/1990 Gueret et al.
4,906,120 A 3/1990 Sekiguchi et al.
4,917,132 A 4/1990 Tuchman
4,927,281 A 5/1990 Gueret et al.
D310,917 S 10/1990 Futter
5,063,947 A 11/1991 Gueret et al.
5,137,038 A 8/1992 Kingsford et al.
5,153,066 A 10/1992 Tanaka et al.
5,165,760 A 11/1992 Gueret et al.
5,211,494 A 5/1993 Baijnath et al.
5,220,702 A 6/1993 Howell et al.
5,301,695 A 4/1994 Wong
5,328,282 A 7/1994 Charrier et al.
5,339,483 A 8/1994 Byun et al.
5,388,599 A 2/1995 Yen et al.
D362,965 S 10/1995 Tastanis
5,482,059 A 1/1996 Miraglia
5,491,865 A 2/1996 Gueret
5,507,063 A 4/1996 Hirsch
5,535,474 A 7/1996 Salazar
5,588,447 A 12/1996 Gueret
5,596,785 A 1/1997 Park
D380,615 S 7/1997 Roberts
5,690,441 A 11/1997 McManus
5,778,479 A 7/1998 Raia
5,802,658 A 9/1998 Ward
5,960,745 A 10/1999 Boyland
5,992,423 A 11/1999 Tevolini
6,026,824 A 2/2000 Gueret
D421,846 S 3/2000 Choe
6,039,051 A 3/2000 Dorf
D425,794 S 5/2000 Grossnickle
6,059,474 A 5/2000 Huang
6,070,597 A 6/2000 Motherhead
D434,187 S 11/2000 Schoon et al.
6,145,151 A 11/2000 Herron et al.
6,145,514 A 11/2000 Clay et al.
6,158,443 A 12/2000 Leman et al.
6,164,857 A 12/2000 Wolfarth-Brooks et al.
D439,415 S 3/2001 Mink et al.
D442,369 S 5/2001 Damiano
6,224,287 B1 5/2001 Gieux
6,226,828 B1 5/2001 Lin
6,234,181 B1 5/2001 Lou
6,269,515 B1 8/2001 Varma
D448,178 S 9/2001 Tapley et al.
6,298,863 B1 10/2001 Byun
6,309,125 B1 10/2001 Peters
D450,189 S 11/2001 Mink et al.
D450,930 S 11/2001 Mink et al.
D450,931 S 11/2001 Mink et al.
6,311,358 B1 11/2001 Soetewey et al.
6,312,182 B1 11/2001 Dumler
D451,681 S 12/2001 Mink et al.
D454,001 S 3/2002 Mink et al.
6,363,948 B2 4/2002 Choi
6,401,290 B1 6/2002 Barton et al.
6,405,402 B1 6/2002 Choi
6,418,939 B1 7/2002 Byun
6,438,784 B1 8/2002 Yu
D471,018 S 3/2003 Mink
D479,917 S 9/2003 Mink
D479,918 S 9/2003 Mink
D480,218 S 10/2003 Mink
6,669,389 B2 12/2003 Gueret
D485,442 S 1/2004 Twigg
6,832,405 B1 12/2004 Miller
6,880,197 B2 4/2005 Katz et al.
6,898,818 B2 5/2005 Lin
D506,069 S 6/2005 Woods
6,935,802 B1 8/2005 Byun
6,957,468 B2 10/2005 Driesen et al.
6,974,513 B2 12/2005 Kepka
7,096,598 B1 8/2006 Myatt
D527,529 S 9/2006 Ajluni et al.
D528,305 S 9/2006 Langer
7,101,107 B1 9/2006 Byun
7,107,645 B2 9/2006 Bressler et al.
7,111,354 B2 9/2006 Nennig et al.
D529,292 S 10/2006 Langer
7,127,770 B2 10/2006 Clegg et al.
7,159,950 B2 1/2007 Young-Chul

(56) References Cited

U.S. PATENT DOCUMENTS

| | | | | |
|---|---|---|---|---|
| 7,201,527 | B2 | 4/2007 | Thorpe et al. | |
| 7,234,474 | B2 | 6/2007 | Byun | |
| 7,275,885 | B2 | 10/2007 | Byun | |
| D562,005 | S | 2/2008 | King | |
| D562,566 | S | 2/2008 | Mink | |
| 7,344,327 | B2 | 3/2008 | Gueret | |
| D566,969 | S | 4/2008 | Sherman et al. | |
| D568,050 | S | 5/2008 | Huang | |
| D571,105 | S | 6/2008 | Godin | |
| 7,429,141 | B2 | 9/2008 | Habatjou | |
| 7,465,113 | B2 | 12/2008 | Gueret | |
| D584,897 | S | 1/2009 | Belley | |
| D601,804 | S | 10/2009 | Hwang | |
| 7,653,960 | B2 | 2/2010 | Lee | |
| D612,615 | S | 3/2010 | Chitayat et al. | |
| 7,716,775 | B2 | 5/2010 | DiPietro et al. | |
| D626,338 | S | 11/2010 | Ajootian | |
| 7,866,758 | B2 | 1/2011 | Jang | |
| D631,666 | S | 2/2011 | Lim | |
| D632,488 | S | 2/2011 | Twigg | |
| 7,895,696 | B2 | 3/2011 | Belmonte | |
| 7,895,698 | B2 | 3/2011 | Mink | |
| 7,918,620 | B2 | 4/2011 | Del Ponte | |
| 7,950,402 | B1 | 5/2011 | Cole | |
| 7,996,947 | B2 | 8/2011 | Gueret | |
| 8,074,666 | B2 | 12/2011 | Piao | |
| D651,409 | S | 1/2012 | Papenfu | |
| 8,104,132 | B2 | 1/2012 | Mink | |
| 8,117,707 | B1 | 2/2012 | Ruh, II | |
| 8,132,285 | B2 | 3/2012 | Piao | |
| 8,132,541 | B1 | 3/2012 | Baer, Jr. | |
| 8,141,561 | B2 | 3/2012 | Thorpe et al. | |
| D658,385 | S | 5/2012 | Lim et al. | |
| D658,389 | S | 5/2012 | Salgatar | |
| 8,185,998 | B2 | 5/2012 | Xu | |
| 8,220,469 | B1 | 7/2012 | Spagnuolo | |
| 8,230,543 | B2 | 7/2012 | Shrier et al. | |
| 8,251,074 | B2 | 8/2012 | Pires et al. | |
| 8,256,058 | B2 | 9/2012 | Telwar | |
| 8,307,836 | B2 | 11/2012 | Pires et al. | |
| 8,321,987 | B2 | 12/2012 | Bagley | |
| 8,360,078 | B2 | 1/2013 | Lim et al. | |
| D677,059 | S | 3/2013 | Floyd | |
| D677,060 | S | 3/2013 | Floyd | |
| D677,470 | S | 3/2013 | Floyd | |
| 8,402,592 | B2 | 3/2013 | Byrne et al. | |
| D681,342 | S | 5/2013 | Brower | |
| 8,850,652 | B2 | 10/2014 | Lim | |
| D717,548 | S | 11/2014 | Lim | |
| 8,881,745 | B2 | 11/2014 | Pires et al. | |
| 8,899,243 | B2 | 12/2014 | Pires et al. | |
| D725,912 | S | 4/2015 | Sims et al. | |
| D730,062 | S | 5/2015 | Lim | |
| D739,148 | S | 9/2015 | Lim | |
| D767,903 | S | 10/2016 | Lim | |
| D778,069 | S | 2/2017 | Lim | |
| 10,098,438 | B2 * | 10/2018 | Pires | A45D 40/267 |
| 2002/0078902 | A1 | 6/2002 | Ehrmann | |
| 2002/0148058 | A1 | 10/2002 | Greenwood et al. | |
| 2003/0005533 | A1 | 1/2003 | Woodnorth et al. | |
| 2003/0035953 | A1 | 2/2003 | Weihrauch | |
| 2003/0066151 | A1 | 4/2003 | Chang | |
| 2003/0110585 | A1 | 6/2003 | Rechelbacher | |
| 2004/0134009 | A1 | 7/2004 | Sander et al. | |
| 2004/0168700 | A1 | 9/2004 | Dorf | |
| 2005/0011030 | A1 | 1/2005 | Gonzalez | |
| 2005/0031401 | A1 | 2/2005 | Gueret | |
| 2005/0198759 | A1 | 9/2005 | Segrea | |
| 2005/0273962 | A1 | 12/2005 | Dillon | |
| 2006/0026783 | A1 | 2/2006 | McKay | |
| 2006/0150355 | A1 | 7/2006 | Mason et al. | |
| 2006/0162736 | A1 | 7/2006 | Gray | |
| 2006/0254012 | A1 | 11/2006 | Konishi | |
| 2006/0272668 | A1 | 12/2006 | Wyatt et al. | |
| 2007/0034224 | A1 | 2/2007 | Dumler | |
| 2007/0124882 | A1 | 6/2007 | Lee | |
| 2007/0151061 | A1 | 7/2007 | Mink et al. | |
| 2007/0199575 | A1 | 8/2007 | Del Ponte | |
| 2007/0289602 | A1 | 12/2007 | Simmons | |
| 2007/0295351 | A1 | 12/2007 | Germer | |
| 2008/0060668 | A1 | 3/2008 | Legassie | |
| 2008/0256733 | A1 | 10/2008 | Brown | |
| 2008/0276396 | A1 | 11/2008 | Lucero | |
| 2009/0014022 | A1 | 1/2009 | Salciarini | |
| 2009/0041530 | A1 | 2/2009 | Deans | |
| 2009/0089949 | A1 | 4/2009 | Mink et al. | |
| 2009/0119863 | A1 | 5/2009 | Gallegos | |
| 2009/0183328 | A1 | 7/2009 | King | |
| 2009/0260172 | A1 | 10/2009 | Weiss | |
| 2010/0000566 | A1 | 1/2010 | Wyatt et al. | |
| 2010/0017990 | A1 | 1/2010 | Piao | |
| 2010/0037407 | A1 | 2/2010 | Telwar | |
| 2010/0043815 | A1 | 2/2010 | Levy et al. | |
| 2010/0059080 | A1 | 3/2010 | Gueret | |
| 2010/0200013 | A1 | 8/2010 | Kim | |
| 2010/0212682 | A1 | 8/2010 | Pires et al. | |
| 2010/0224208 | A1 | 9/2010 | Thorpe et al. | |
| 2010/0236004 | A1 | 9/2010 | Xu | |
| 2011/0056505 | A1 | 3/2011 | Parkinson et al. | |
| 2011/0083690 | A1 | 4/2011 | Cardenas et al. | |
| 2012/0017930 | A1 | 1/2012 | Nance | |
| 2012/0167910 | A1 | 7/2012 | Weigel | |
| 2012/0260931 | A1 | 10/2012 | Martin et al. | |
| 2012/0272982 | A1 | 11/2012 | Telwar et al. | |
| 2012/0298130 | A1 | 11/2012 | Telwar | |
| 2013/0017010 | A1 | 1/2013 | Liu | |
| 2013/0111683 | A1 | 5/2013 | Lim et al. | |
| 2014/0216497 | A1 | 8/2014 | Gueret | |
| 2014/0259489 | A1 | 9/2014 | Dale | |
| 2014/0325775 | A1 | 11/2014 | Nakamura et al. | |
| 2014/0331422 | A1 | 11/2014 | Lim | |
| 2014/0332027 | A1 | 11/2014 | Lim | |
| 2015/0010340 | A1 | 1/2015 | Pires et al. | |
| 2017/0265626 | A1 | 9/2017 | Earl et al. | |
| 2018/0055205 | A1 * | 3/2018 | Pires | A45D 40/265 |
| 2018/0177281 | A1 * | 6/2018 | Pires | A45D 40/264 |
| 2018/0255908 | A1 * | 9/2018 | Wightman | A45D 40/267 |

FOREIGN PATENT DOCUMENTS

| | | | |
|---|---|---|---|
| DE | 29713124 | U1 | 9/1997 |
| EP | 2084986 | A2 | 8/2009 |
| FR | 2464674 | A1 | 3/1981 |
| FR | 2642283 | A1 | 8/1990 |
| FR | 2976463 | A1 | 12/2012 |
| JP | 2003033228 | A | 2/2003 |
| JP | 2003135140 | A | 5/2003 |
| JP | 1218834 | C | 10/2004 |
| JP | 1343552 | C | 11/2008 |
| JP | 2009172300 | A | 8/2009 |
| KR | 300365471 | | 10/2004 |
| KR | 300404554 | | 12/2004 |
| KR | 300607863 | | 8/2011 |
| KR | 1020130025549 | A | 3/2013 |
| KR | 101257563 | B1 | 5/2013 |
| KR | 200472950 | Y1 | 5/2013 |
| WO | 9211785 | A1 | 7/1992 |
| WO | 2006034815 | A2 | 4/2006 |
| WO | 2007117091 | A1 | 10/2007 |
| WO | 2010098997 | A1 | 9/2010 |
| WO | 2016177827 | A1 | 11/2016 |
| WO | 2018152182 | A1 | 8/2018 |
| WO | 2018152185 | A1 | 8/2018 |
| WO | 2018152191 | A1 | 8/2018 |

OTHER PUBLICATIONS

CN 3417893 Registered Design, (Tianjin Samsun Brushes Ltd.) Jan. 12, 2005, [online], [retrieved on Oct. 3, 2014] Retrieved from the Questel Intellectual Property Portal Design Database using the Internet: <URL: http://www.orbit.com.

Dual Interchangeable Brush Set, Global Market, retrieved on Mar. 18, 2015 at <>, 2 pages.

(56) References Cited

OTHER PUBLICATIONS

Everbluec Singapore Beauty Makeup and Skincare Blog, May 14, 2011 [online], Elizabeth Arden makeup blender, [retrieved on Mar. 14, 2015] Retrieved from the Internet: http://everbluec.com/2011/05/ceramide-colors-exclusive-launch-at.html>-.

Fingermax Creative Finger Painting Paint Brush, retrieved on Oct. 9, 2014 at http://thesotre.com/fingermax-creative-finger-painting-paint-br- ush/TSHVY6X6YF», 5 Pages.

Givenchy Demesure Audacious Lashes Mascara, May 17, 2011, retrieved from the internet at <>, 9 pages.

Lady Zona, "Choosing the Right Make Up Brush", Retrieved on Feb. 24, 2015 at <&- gt;, 3 pages.

Latest design double end kabuki blush brush, Alibaba.com, retrieved on Mar. 18, 2015 at <>, 3 pages.

Launch Pad Mojo Magpro Professional Magnetic Brush Set, Beauty and the Blog, retrieved on Feb. 26, 2015 at «http://www.beautyandblog.com/2012/01/launch-pad-mojo-magpro-profe- ssional.html, 4 pages.

LeKeux, "My Cosmetic Range" LeKeux HQ, retrieved on Feb. 24, 2015 at <&- gt;, 6 Pages.

Makeup Brushes Buying Guide, Ebay, Jun. 9, 2014, retrieved on Mar. 18, 2015 at <>, 6 pages.

Popcorn Yubi-fude Finger Brush, Japan Trend Shop, retrieved on Oct. 8, 2014 at <>, 3 pages.

Why Didn't We Think of That: Magnetic Makeup Brush, Gloss Daily, retrieved on Feb. 26, 2015 at <>, 2 pages.

International Search Report and Written Opinion dated May 25, 2018 for International Application No. PCT/US2018/018158.

International Search Report and Written Opinion dated May 25, 2018 for International Application No. PCT/US2018/018167.

International Search Report and Written Opinion dated May 25, 2018 for International Application No. PCT/US2018/018153.

* cited by examiner

ADJUSTABLE APPLICATOR

CROSS REFERENCE TO RELATED PATENT APPLICATIONS

The present application claims the benefit of and priority to Indian Patent Application Serial Number 201711005605, filed on Feb. 16, 2017, the disclosure of which is incorporated herein by reference.

TECHNICAL FIELD

Embodiments of the present disclosure relate to an adjustable applicator for applying a cosmetic or personal care composition, e.g. mascara to eyelashes or eyebrows. More particularly, the disclosure, relates to an applicator that can be adjusted as per a user's convenience for application of a cosmetic or a care product.

BACKGROUND

Mascara, an important make-up accessory used to darken and define eyelashes to accentuate the eyes, is difficult to apply because of the target area of application. The eyelashes offer a very small application area, while being soft, flexible, delicate and in close proximity to very sensitive eye tissue. Therefore, a mascara product would be liked by the consumers when a right kind of applicator is provided to them for easy application as the overall consumer experience depends on both the product and on the applicator used to apply it.

Conventional mascara brushes are in the form of a generally cylindrical straight rod carrying a plurality of bristles extending radially outwardly from its outer surface. However, straight mascara brushes are not thought by some people to be ideal for all purposes and curved mascara brushes are also known.

One applicator may be generally straight and have short, densely arrayed bristles and may be employed for applying mascara to eyelashes to achieve a desired effect (e.g. to volumize eyelashes). While another applicator may incorporate a bend and have longer, less densely arrayed bristles for applying mascara to eyelashes to achieve an alternative desired effect (e.g., to separate and define eyelashes).

Curved mascara brushes permit contact of the brush with more eyelashes along a correspondingly curved eyelid. However, the curved brush is more difficult to use in the confines of the eye area, particularly the corners of the eye where a straight brush works better. Another drawback of a pre-curved brush is that it is not readily adjustable to confirm to a particular user's eyelid curvature. In addition, the curvature of the upper and lower eyelids is rarely the same and a brush curved to fit the upper lid will not properly fit the lower lid.

Adjustable mascara brushes are known in the prior art. It is known to provide adjustment of the angle of the brush or applicator relative to the applicator wand or handle.

Thus, existing applicators have limited functionality and are not conducive to applying mascara to eyelashes using different techniques and/or different orientations. Accordingly, there remains a need in the art for improved applicator systems that allow application of mascara using different techniques and/or orientations to achieve multiple desired effects.

Therefore, there exists a need for an applicator that provides ease-of-use as well as is modifiable to adapt to the shape requirement of the user.

SUMMARY

The present disclosure generally is an adjustable applicator employed for application of a cosmetic or a care product such as for application of mascara, coloring strands of hair, for dental flossing or for applying pharmaceuticals or cleaning agents. The use of adjustable applicator of the present disclosure for removal of make-up products is also contemplated.

According to an embodiment of the present disclosure, there is provided an adjustable applicator including an application member that can be adjusted as per user's convenience for application of a cosmetic or a care product.

In accordance with an embodiment of the disclosure, the adjustable applicator extends along a longitudinal axis and comprises of an applicator head comprising an application member; a stem and a cap; wherein the applicator head is connected at a distal end of the stem and the cap is connected at a proximal end of the stem.

In accordance with an embodiment of the disclosure, the adjustable applicator includes an actuator formed by an upper portion of the cap, which when actuated initiates a mechanism for progressive modification in the shape of the applicator head.

According to an embodiment, the actuator is a dialer but in other alternate embodiments, the dialer can be replaced by other actuator such as a slider, a push button and the like which can actuate using manual, mechanical, magnetic, electrical or any other suitable force.

According to an embodiment of the disclosure, the adjustable applicator includes a transmission member having a distal end and a proximal end. The distal end of the transmission member is connected at an end of the applicator head and the proximal end of the transmission member is connected to a dialer of the adjustable applicator.

The actuator is actuated for moving the transmission member along the longitudinal axis to cause progressive modification in shape of the application member.

According to an embodiment of the disclosure, the applicator head comprises an application member and a shank for attaching the applicator head to a distal end of the stem. The application member comprises a flexible support and a plurality of application elements on its surface. The application member has one free end and one fixed end. The fixed end is fixedly connected to the shank. The free end of the application member is connected to a distal end of the transmission member. The application member is flexible as well as elastic in nature. Thus, the application member is capable of changing its shape on application of force because it is flexible in nature and since it is also elastic in nature, it is capable of returning to original shape after removal of force.

According to an embodiment of the disclosure, the application elements are in form of tines molded integrally with the flexible support. However, it would not be beyond the scope of the present disclosure, if the application elements are in form of flocking of fibers, sponge, metal or any other material known in the art.

According to an embodiment of the disclosure, the application elements are present on a surface of the flexible support which faces away from the transmission member. Further, the application elements are present on a portion of a circumference/perimeter of the flexible support and not on the complete circumference/perimeter of the flexible support. However, it would not be beyond the scope of present disclosure, if the application elements are present on a complete circumference/perimeter of a cross-section of the flexible support.

According to an embodiment of the disclosure, the flexible support has a non-circular shape. However, the flexible support may have a shape selected from circular, oval, polygonal, rectangular shape etc.

When the dialer is rotated, the application member can adopt at least two stable configurations including a first configuration in which the transmission member is moved to its maximum extent towards proximal direction and a second configuration in which the transmission member is moved to its maximum extent towards a distal direction.

In the first configuration, the application member has a straight or linear shape whereas in the second configuration, the application member has a curved shape. Further, in the first configuration, the application elements are present only on one side of the transmission member whereas in the second configuration, the application elements are present on two sides of the transmission member.

Still further, in the first configuration, a distal end of the applicator head is formed by a distal most portion of the application member whereas in the second configuration, the distal end of the applicator head is formed by substantially middle portion of the application member. Also, in the first configuration, the applicator head has a curved tip and in the second configuration, the applicator head has a curved tip of radius greater than a radius of the curved tip of the first configuration.

More specifically, in the first configuration, the application member has a J-shape whereas in the second configuration, the application member has a closed loop shape. In the first configuration, the application member has a J-shape. In the first configuration, the flexible support of the application member comprises of a single arm extending from the shank and a curved tip. The curved tip is formed in continuation of the single arm such that a concave side of the curved tip faces towards the distal end of the stem.

In the second configuration, the application member has a closed loop-shape. In the second configuration, the flexible support of the application member comprises two arms and a curved tip formed between the two arms. One end of each of the two arms is in contact with the shank. The two arms together with the curved tip forms a cavity.

Independently or in combination with the above, exemplary embodiments of the disclosure provide a cosmetic package for packaging and dispensing a substance, for example, a cosmetic, comprising an adjustable applicator as defined above. The device may comprise a receptacle and the adjustable applicator. The adjustable applicator in such a device may comprise a cap, a stem having a cavity, an applicator head having an application member and a shank; and a transmission member extending between the applicator head and the cap. The stem may be connected to the applicator head at one end and to the cap at another end. The said device may also include a wiper member. An upper portion of the cap may form an actuator for adjusting the shape of the applicator head and a lower portion of the cap may form a sleeve for closing the receptacle. The actuator is connected to a proximal end of the transmission member in such a way that rotational movement of the transmission member with respect to the actuator is restricted while translational movement is allowed and the transmission member is non-rotatably connected at its distal end to a distal end of the application member of the applicator head.

According to an embodiment, a distal end of the transmission member is fixedly connected in a groove/cavity (not visible) at the free end of the application member and extends outside the flexible support towards the proximal direction of the stem and into the cavity of the stem and the dialer. Alternately, the transmission member may pass through a channel in the flexible support and may or may not be visible outside the flexible support.

According to an embodiment, the dialer is structured in a closed-end cylindrical shape. The dialer further includes an internal annular skirt projecting from an inner surface of a top wall of the dialer and the internal annular skirt extends towards the receptacle. The internal annular skirt has a small outer diameter, and an annular groove is provided on an outer peripheral surface of the internal annular skirt for attaching the dialer to the sleeve of the cap. The sleeve of the cap is attached with the dialer such that the sleeve is free to rotate relative to the dialer via a snap-fit system comprising the external annular groove and a complementary annular protruding portion of the sleeve. The dialer can thus be turned by the user relative to the sleeve. Further, the inner surface of the internal annular skirt includes an inner profile, such as mating threads capable of interacting with an outer thread of the transmission member mounted axially inside the dialer.

According to an embodiment, for engaging the stem to the sleeve of the cap, an upper tubular portion of the stem has a protruding portion on its outer surface which engages with a complementary groove present on inner surface of the sleeve. On the interfaces where the stem is joined to the sleeve of the cap, the stem and the sleeve of the cap both may have complementary longitudinal protrusions and positioning longitudinal grooves that engage with each other for non-rotatably locking the stem and the sleeve together. However, it is not beyond ambit of the present disclosure that any other non-rotatable engagement known in the art may be employed for locking any relative rotation between the stem and the sleeve.

According to an embodiment, the stem comprises the upper tubular portion, a downward skirt and an elongated hollow shaft. The threads are provided on the inner peripheral surface of the downward skirt of the stem to attach the cap to an externally threaded neck of the container. With the cap so attached, the applicator head is immersed in the product to be applied. The elongated hollow shaft extends beyond the neck in the receptacle. Preferably, the elongated hollow shaft of the stem is disposed around at least a portion of the transmission member so that the transmission member is longitudinally movable with respect to the shaft. In the embodiment illustrated, the shaft and the transmission member have circular transverse cross-sections. Other embodiments may have non-circular transverse cross-sections.

According to an embodiment, the stem further includes such features that allow an axial movement of the transmission member but rotation of the transmission member is prevented when the dialer is rotated with respect to the sleeve. For example, the transmission member includes two annular flanges having two opposing slide cut-outs for receiving corresponding longitudinal guide protrusions of the stem. Further, one or more annular ribs and sealing O-rings are configured around the transmission member so that the transmission member interfaces tightly against an inner wall of the shaft. The annular ribs and the sealing O-rings prevent the product from leaking and ensure steady, smooth, and noiseless extension of the transmission member along the shaft.

The adjustable applicator is in the first configuration in the closed position of the cosmetic package and after being removed from the container of the cosmetic the package. In an open position of the cosmetic package, when the dialer is rotated with respect to the sleeve, the transmission member moves longitudinally with respect to the shaft which cause variation in the profile of the application member as explained above. When a suitable adjustment of the profile of the application member has been made it will be retained while the application member is used. The adjustment is retained until the user intentionally rotates the dialer and the sleeve with respect to each other once again to achieve a different adjustment.

In order to transform the profile of the application member to a second configuration, the dialer is twisted in first direction and the rotational movement of the dialer is converted into translational movement of the transmission member by the rotational movement of the threads within the inner skirt of the dialer. Therefore, the transmission member is now able to retract towards the proximal end of the dialer pulling the free end of the application member towards the distal end of the shaft. As the transmission member is retracted to its maximum extent towards the proximal end of the dialer, the free end of the application member contacts the shank at the distal end of the shaft forming a loop shape having two arms and a curved tip and the application member is transformed to a second configuration. The transmission member can be adjusted to various relative longitudinal positions with respect to the shaft depending on degree of twisting, such that as adjustment is made, profile of the application member varies. Once the adjustment is made, it will be retained without any action by the user, until further adjustment is desired and intentionally made.

Further, the user can rotate the dialer in opposite direction to extend the transmission member towards the distal end of the shaft. As the transmission member is extended towards the distal end of the shaft, the free end is pushed in the distal direction of the applicator so that it moves away from the shank and the loop starts opening up so that the cavity disappears. As the transmission member is extended to its maximum extent towards the distal end, the application member is transformed again to the first configuration so that the application member has only one arm.

The material suitable for forming the application member could be any elastomeric polymer, nylon, sponge, metal etc. which possess both flexibility and elasticity. The materials suitable for forming the receptacle could be polypropylene while the dialer, the sleeve, the transmission member and the stem could be formed of acrylonitrile butadiene styrene or any other suitable polymeric material. The material of the transmission member could be any polymeric material like nylon, TPE, PP or could be a suitable metal. The stem may be formed of polyacetal or any other suitable polymeric material. The material for forming the wiper could be low-density polyethylene. The aforementioned materials for forming various parts of the package of the present disclosure are an example, however other suitable materials may also be used.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
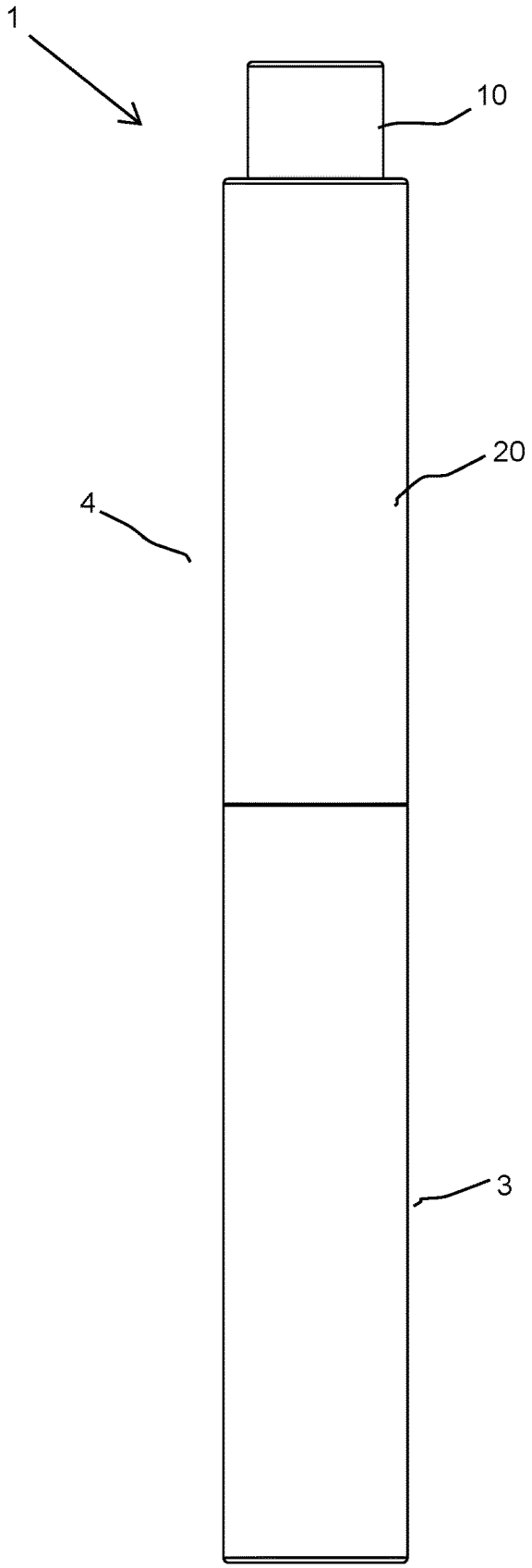
FIG. 1 illustrates a front view of a cosmetic package in closed position according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

FIGS. 1 to 8 show a cosmetic package 1 in accordance with the present disclosure. The cosmetic package 1 includes an application member 41 which can be adjusted as per user's convenience for application of a product including a cosmetic or a care product.

Figure 2:
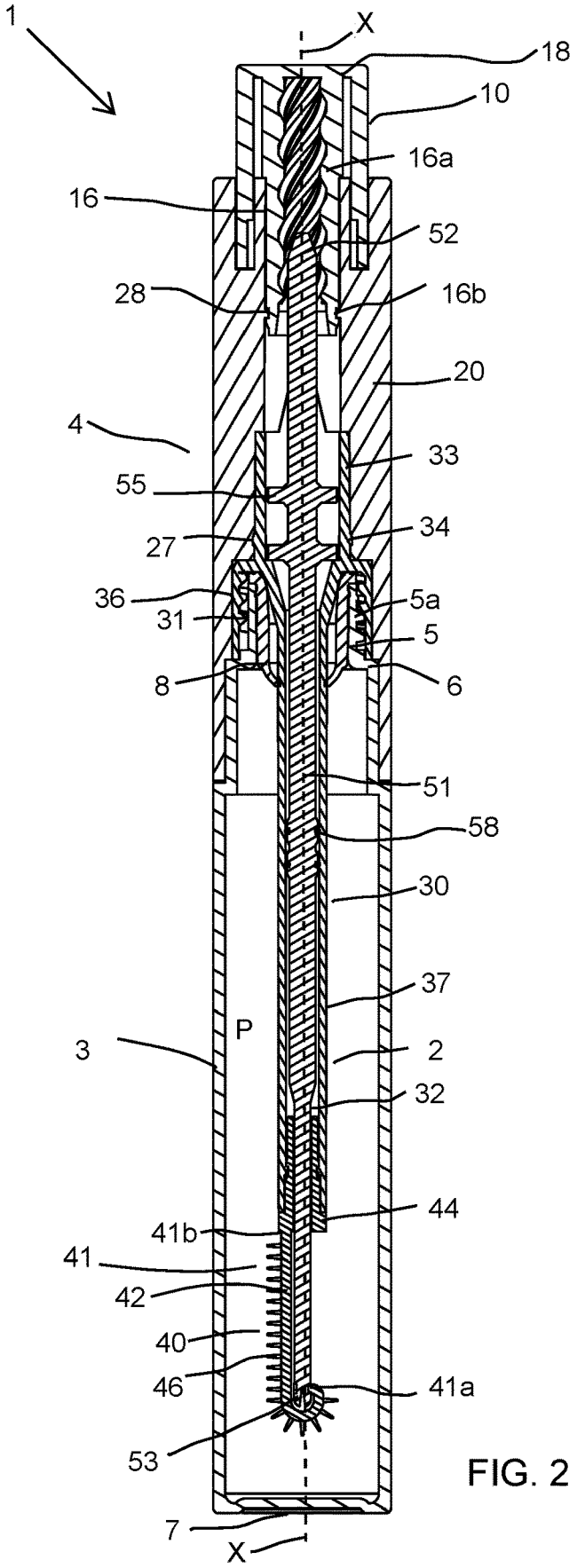
FIG. 2 illustrates a cross sectional view of the cosmetic package of FIG. 1.

FIGS. 1 and 2 show a cosmetic package 1 in accordance with the present disclosure, in a closed position. The cosmetic package 1 having a longitudinal axis X-X, comprises an adjustable applicator 2 and a receptacle 3. The receptacle 3 and the adjustable applicator 2 are intended to be fastened to each other by screwing. Alternatively, other methods of fastening the receptacle 3 and the adjustable applicator 2 can be used. The receptacle 3 includes a neck 5 extending along the longitudinal axis X-X, a shoulder 6 and an end wall 7 forming a reservoir for a product P.

The adjustable applicator 2 includes a cap 4 suitable for closing the receptacle 3, the applicator head 40 comprising the application member 41 and a stem 30 having a cavity 32. The stem 30 may be connected to the applicator head 40 at one end and to the cap 4 at another end. The applicator head 40 is secured to the stem 30 and intended for being inserted in said receptacle 3 in order to be loaded with the product P to be applied.

The neck 5 of the receptacle 3 is provided with an external thread 5*a* intended for cooperating with a complementary thread 31 carried by the stem 30, allowing the receptacle 3 to be closed by screwing.

For some cosmetic products, such as mascara or a lip gloss, it is preferable to provide a wiper 8 positioned into the neck 5 of the receptacle 3 to wipe excess product P from the adjustable applicator 2 as the adjustable applicator 2 is withdrawn from the receptacle 3. The wiper 8 is preferably made of an elastomeric plastic material.

The adjustable applicator 2 includes a transmission member 51 having a distal end 53 and a proximal end 52. The distal end 53 of the transmission member 51 is connected at an end of the applicator head 40 and the proximal end 52 of the transmission member 51 is connected to a dialer 10 of the adjustable applicator 2.

The cap 4 comprises an upper portion comprising the dialer 10 and a lower portion comprising a sleeve 20 connected to the dialer 10. According to other embodiments, the dialer 10 can be replaced by other actuator such as of a slider, a push button and the like which can actuated using manual, mechanical, magnetic, electrical or any other suitable force. For example, rather than a dialer 10 with internal threading, the proximal end of the transmission member 51 may simply be attached to a cap piece which can be pulled proximally or pushed distally relative to sleeve 20.

Figure 5:
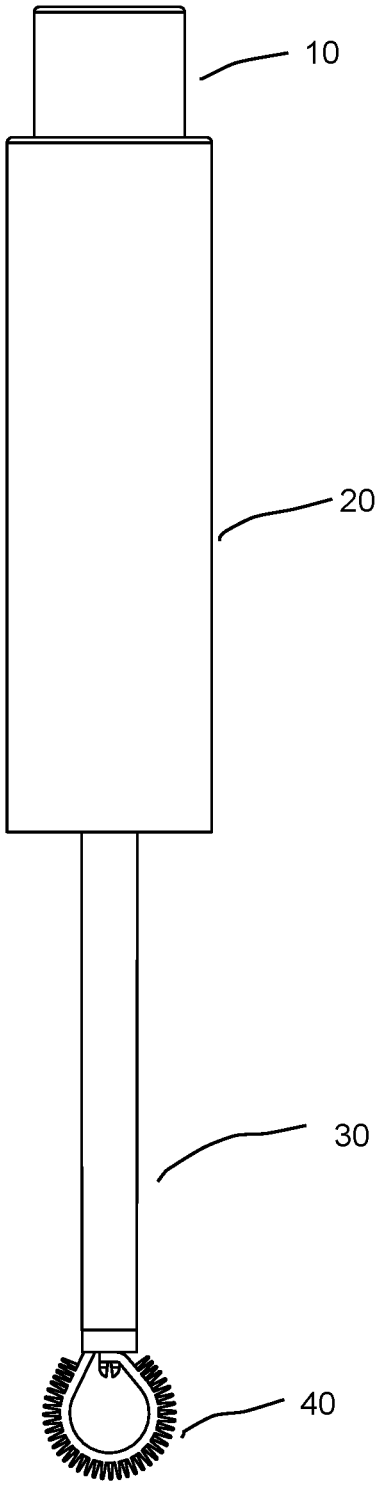
FIG. 5 illustrates front view of a second configuration of an adjustable applicator of the cosmetic package of FIG. 1.
Figure 6:
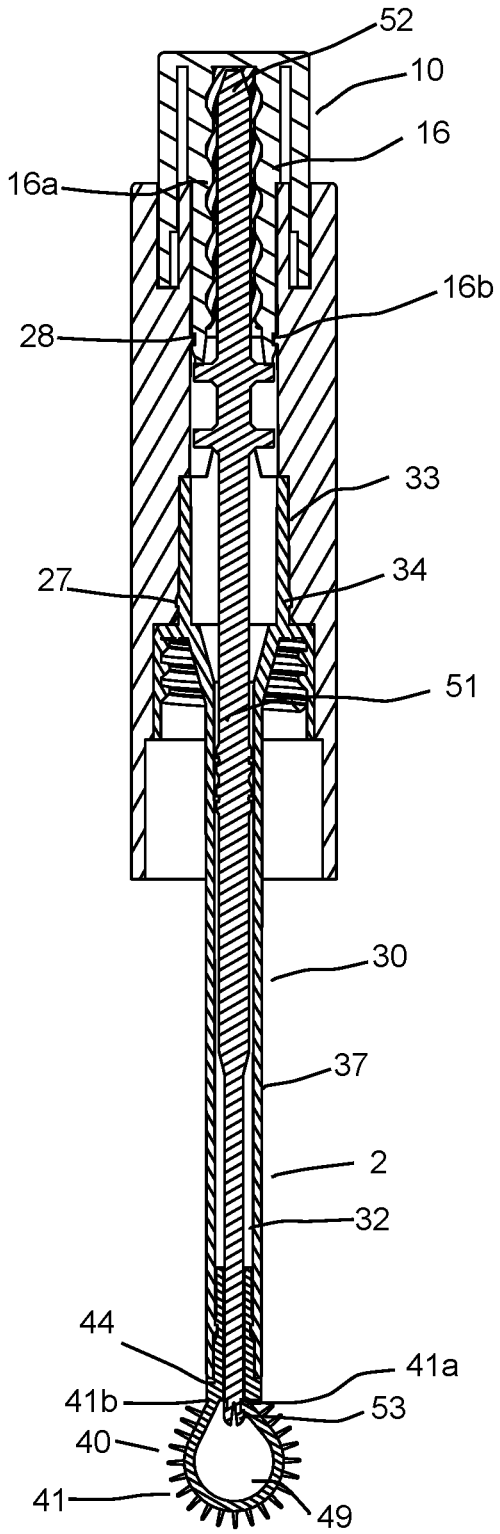
FIG. 6 illustrates a cross sectional view of the second configuration of the adjustable applicator shown in FIG. 5.

As shown in FIGS. 5 and 6, the dialer 10 is rotated for moving the transmission member 51 along the longitudinal axis X-X of the adjustable applicator 2 to cause progressive modification in shape of the application member 41.

As shown in FIGS. 2, 6, 7 and 8, the applicator head 40 comprises an application member 41 and a shank 44 for attaching the applicator head 40 to a distal end of the stem 30. The application member 41 comprises a flexible support 42 and a plurality of application elements 46 extending outward from its surface. The application member 41 has one free end 41*a* and one fixed end 41*b*. The fixed end 41*b* is fixedly connected to the shank 44. The free end 41*a* of the application member 41 is connected to a distal end 53 of the transmission member 51. The application member 41 is flexible as well as elastic in nature. Thus, application member 41 is capable of changing its shape on application of force because it is flexible in nature and since it is also elastic in nature it is capable of returning to original shape after removal of force.

The application elements 46 are in form of tines molded integrally with the flexible support 42. However, it would not be beyond the scope of the present disclosure, if the application elements are in form of flocking of fibers, sponge, metal or any other material known in the art.

Figure 7:
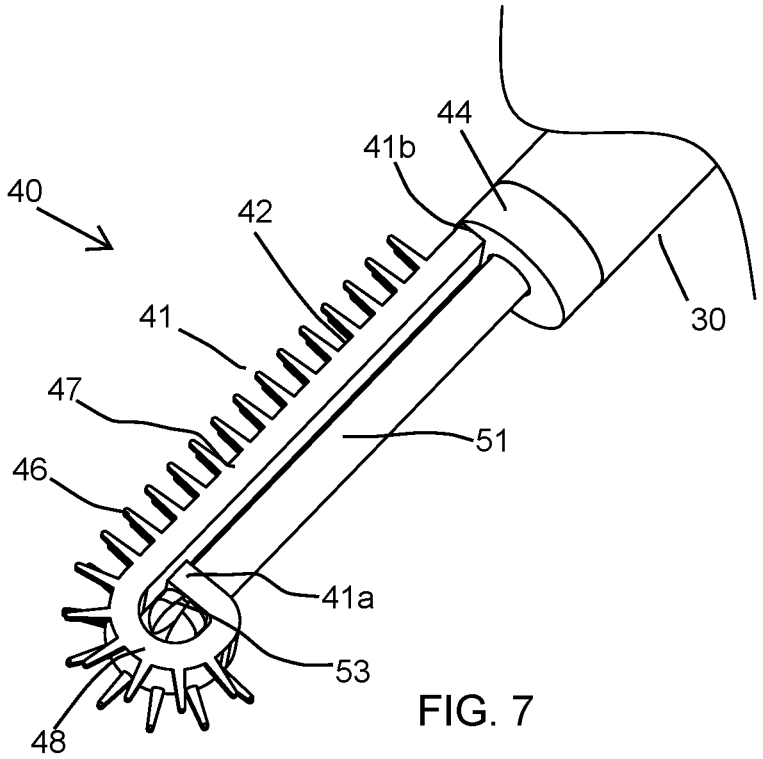
FIG. 7 illustrates enlarged perspective view of the first configuration of the adjustable applicator shown in FIG. 4.
Figure 8:
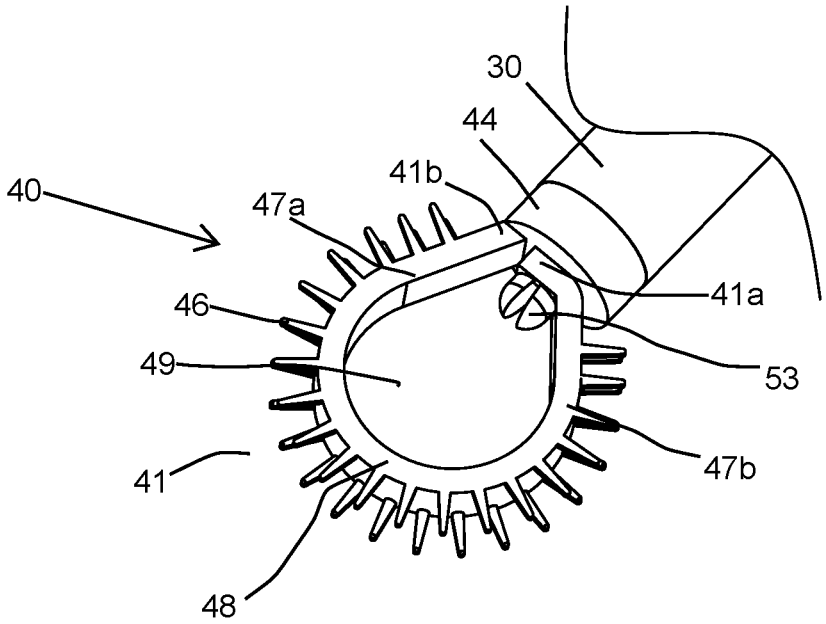
FIG. 8 illustrates enlarged perspective view of the second configuration of the adjustable applicator shown in FIG. 5.

As shown in FIGS. 7 and 8, the application elements 46 are present on a surface of the flexible support 42 which faces away from the transmission member 51. Further, as shown in FIGS. 7 and 8, the application elements 46 are present on only a portion of a circumference/perimeter of the flexible support 42 of the application member 41 and not on the complete circumference/periphery of the flexible support 42. For example, as shown in FIG. 7, the surface of the application member 41 facing the transmission member 51 may be devoid of application elements 46. When moved into the closed loop second configuration shown in FIG. 8, the interior surface of the closed loop application member 41 may be devoid of application elements 46. However, it would not be beyond the scope of present disclosure, if the application elements 46 are present on a complete circumference/perimeter of the flexible support 42.

As shown in FIGS. 7 and 8, the flexible support 42 has a non-circular shape. However, the flexible support 42 may have a shape selected from circular, oval, polygonal, rectangular shape etc.

Figure 4:
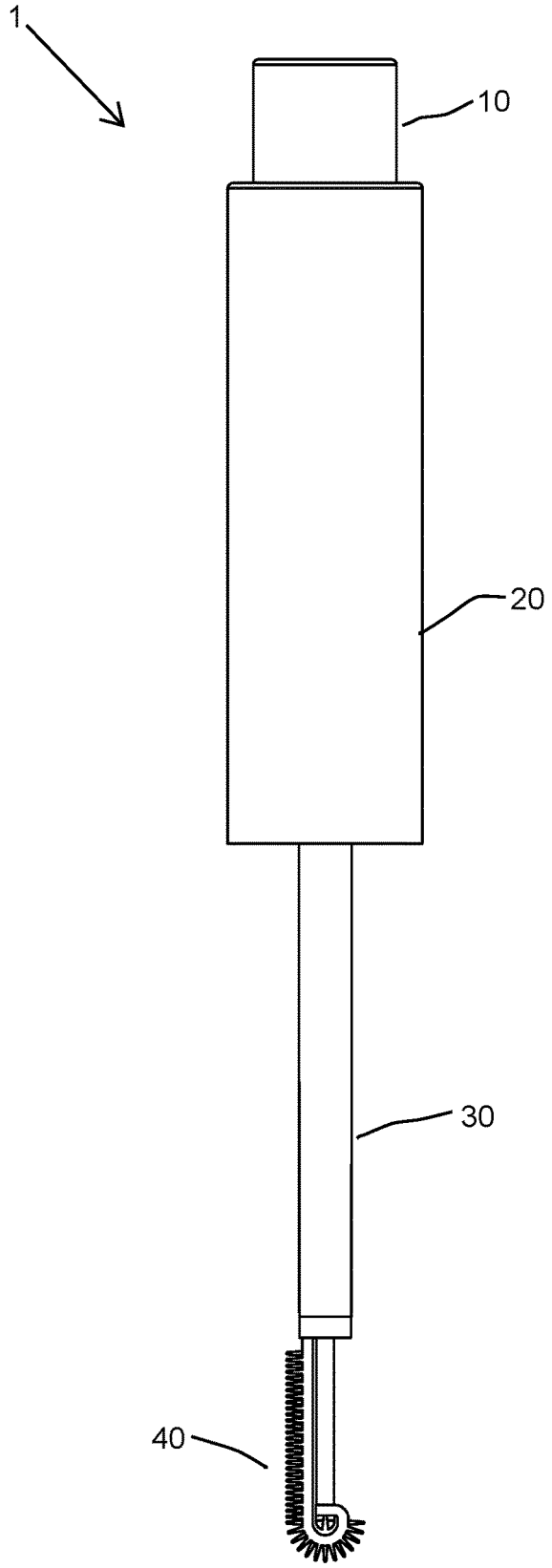
FIG. 4 illustrates a front view of a first configuration of an adjustable applicator of the cosmetic package of FIG. 1 after being removed from a container of the cosmetic package.

When the dialer 10 is rotated, the application member 41 can adopt at least two stable configurations that is to say a first configuration as shown in FIGS. 2, 4 and 7 in which the transmission member 51 is moved to its maximum extended position and a second configuration as shown in FIGS. 5, 6 and 8 in which the transmission member 51 is moved to its maximum retracted position within the stem 30.

In the first configuration as shown in FIGS. 2, 4 and 7, the application member 41 has a straight shape whereas in the second configuration as shown in FIGS. 5, 6 and 8, the application member 41 has a curved shape.

Further, in the first configuration as shown in FIGS. 2, 4 and 7, the application elements 46 are present only on one side of the transmission member 51 whereas in the second configuration as shown in FIGS. 5, 6 and 8, the application elements 46 are present on two sides of the transmission member 51.

Still further, in the first configuration as shown in FIGS. 2, 4 and 7, a distal end of the applicator head 40 is formed by a distal most portion of the application member 41 whereas in the second configuration as shown in FIGS. 5, 6 and 8, the distal end of the applicator head 40 is formed by substantially a middle portion of the application member 41. Also, in the first configuration, the applicator head has a linear portion and a curved tip and in the second configuration, the applicator head 40 has a curved tip of radius greater than a radius of the curved tip of the first configuration.

More specifically, in the first configuration as shown in FIGS. 2, 4 and 7, the application member 41 has a J-shape whereas in the second configuration as in FIGS. 5, 6 and 8, the application member 41 has a closed loop shape.

As shown in FIGS. 2, 4 and 7, in the first configuration, the application member 41 has a J-shape. In the first configuration, the flexible support 42 of the application member 41 comprises of a single linear arm 47 extending from the shank 44 and a curved tip 48. The curved tip 48 is formed in continuation of the single arm 47 such that a concave side of the curved tip 48 faces towards the distal end of the stem 30.

In the second configuration, as shown in FIGS. 5, 6 and 8, the application member 41 has a closed loop-shape. In the second configuration, the flexible support 42 of the application member 41 comprises of two arms 47*a* and 47*b* and a curved tip 48 formed between the two arms 47*a* and 47*b*. One end of each of the two arms is in contact with the shank 44. The two arms 47*a* and 47*b* together with the curved tip 48 form a cavity 49.

As shown in FIGS. 2, 6, 7 and 8, the distal end 53 of the transmission member 51 is fixedly connected in a groove/cavity (not visible) at the free end 41*a* of the application member 41 and extends outside the flexible support 42 towards the proximal direction of the stem 30 and into the cavity 32 of the stem 30 and the dialer 10. Alternately, the transmission member 51 may pass through a channel in the flexible support 42 and may or may not be visible outside the flexible support 42.

Figure 3:
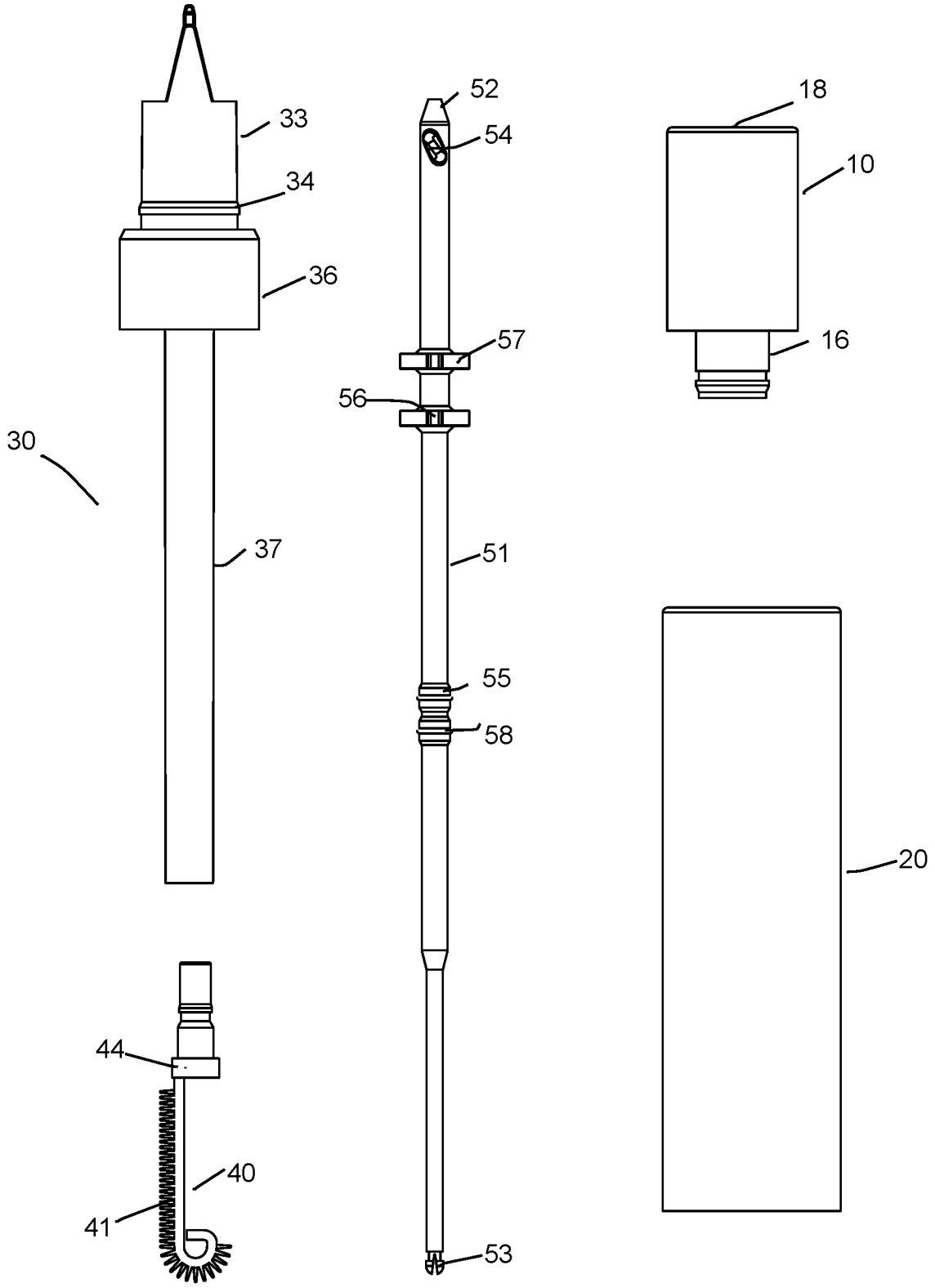
FIG. 3 illustrates exploded view of the cosmetic package of FIG. 1.

As shown in FIGS. 2, 3 and 6, the dialer 10 is structured in a closed-end cylindrical shape. The dialer 10 further includes an internal annular skirt 16 projecting from an inner surface of a top wall 18 of the dialer 10 and the internal annular skirt 16 extends towards the receptacle 3. The internal annular skirt 16 has a small outer diameter, and an annular groove 16*b* is provided on an outer peripheral surface of the internal annular skirt 16 for attaching the dialer 10 to the sleeve 20 of the cap 4. The sleeve 20 of the cap 4 is attached with the dialer 10 such that the sleeve 20 is free to rotate relative to the dialer 10 via a snap-fit system comprising the external annular groove 16*b* and a complementary annular protruding portion 28 of the sleeve 20. The dialer 10 can thus be turned by the user relative to the sleeve 20. Further, the inner surface of the internal annular skirt 16 includes an inner profile, such as mating threads 16*a* capable of interacting with an outer thread 54 (FIG. 3) of the transmission member 51 mounted axially inside the dialer 10.

Further, as seen in FIGS. 2, 3 and 6, for engaging the stem 30 to the sleeve 20 of the cap 4, an upper tubular portion 33 of the stem 30 has a protruding portion 34 on its outer surface which engages with a complementary groove 27 present on inner surface of the sleeve 20. On the interfaces where the stem 30 is joined to the sleeve 20 of the cap 4, the stem 30 and the sleeve 20 of the cap 4 both may have complementary longitudinal protrusions and positioning longitudinal grooves (not shown) that engage with each other for non-rotatably locking the stem 30 and the sleeve 20 together. However, it is not beyond ambit of the present disclosure that any other non-rotatable engagement known in the art may be employed for locking any relative rotation between the stem 30 and the sleeve 20.

Further, as seen in FIGS. 2 and 3, the stem 30 comprises the upper tubular portion 33, a downward skirt 36 and an elongated hollow shaft 37. The threads 31 are provided on the inner peripheral surface of the downward skirt 36 of the stem 30 to attach the cap 4 to an externally threaded neck 5 of the receptacle 3. With the cap 4 so attached, the applicator head 40 is immersed in the product P to be applied. The elongated hollow shaft 37 extends beyond the neck 5 in the receptacle 3. Preferably, the elongated hollow shaft 37 of the stem 30 is disposed around at least a portion of the transmission member 51 so that the transmission member 51 is longitudinally movable with respect to the shaft 37.

In the embodiment illustrated, the shaft 37 and the transmission member 51 have circular transverse cross-sections. Other embodiments may have non-circular transverse cross-sections. In the example shown, the transmission member is a single piece; in other examples, there may be a plurality of parts to the transmission member which are secured together, or the transmission member may include a filament therein with overmolded pieces for example to aid in control at the proximal end thereof.

In the present embodiment, the stem 30 further includes such features that allow an axial movement of the transmission member 51 but rotation of the transmission member 51 is prevented when the dialer 10 is rotated with respect to the sleeve 20. For example, as seen in FIGS. 2, 3 and 6, the transmission member 51 includes two annular flanges 57 having two opposing slide cut-outs 56 for receiving corresponding longitudinal guide protrusions (not shown) of the stem 30. Further, one or more annular ribs 55 and sealing O-rings 58 are configured around the transmission member 51 so that the transmission member 51 interfaces tightly against an inner wall of the shaft 37 (see FIGS. 2 and 3). The annular ribs 55 and the sealing O-rings 58 prevent the product P from leaking and ensure steady, smooth, and noiseless extension of the transmission member 51 along the shaft 37.

The adjustable applicator 2 is in first configuration in the closed position of the cosmetic package 1 as shown in FIGS. 1 and 2 and after being removed from the receptacle 3 of the cosmetic package 1 as shown in FIG. 4.

In open position of the cosmetic package 1, when the dialer 10 is rotated with respect to the sleeve 20 the transmission member 51 moves longitudinally with respect to the shaft 37 which cause variation in the profile of the application member 41 as explained above. When a suitable adjustment of the profile of the application member 41 has been made it will be retained while the application member 41 is used. The adjustment is retained until the user intentionally rotates the dialer 10 and the sleeve 20 with respect to each other once again to achieve a different adjustment.

In order to transform the profile of the application member 41 to a second configuration as shown in FIGS. 5, 6 and 8, the dialer 10 is twisted in first direction and the rotational movement of the dialer 10 is converted into longitudinal movement of the transmission member 51 by the rotational movement of the threads 16*a* within the internal annular skirt 16 of the dialer 10. Therefore, the transmission member 51 is now able to retract towards a proximal end of the dialer 10 pulling the free end 41*a* of the application member 41 towards the distal end of the shaft 37. As the transmission member 51 is retracted to its maximum extent towards the proximal end of the dialer 10, the free end 41*a* of the application member 41 contacts the shank 44 at the distal end of the shaft 37 forming a loop shape having two arms 47*a* and 47*b* and a curved tip 48 and the application member 41 is transformed to the second configuration shown in FIGS. 5, 6, and 8.

The transmission member 51 can be adjusted to various relative longitudinal positions with respect to the shaft 37 depending on degree of twisting, such that as adjustment is made, profile of the application member 41 varies incrementally between the first configuration shown in FIGS. 2, 4, and 7 and the second configuration shown in FIGS. 5, 6, and 8. Once the adjustment is made, it will be retained without any action by the user, until further adjustment is desired and intentionally made.

Further, the user can rotate the dialer 10 in opposite direction to extend the transmission member 51 towards the distal end of the shaft 37. As the transmission member 51 is extended towards the distal end of the shaft 37, the free end 41*a* is pushed in the distal direction of the adjustable applicator 2 so that it moves away from the shank 44 and the loop starts opening up so that the cavity 49 disappears. As the transmission member 51 is extended to its maximum extent towards the distal end, the application member 41 is transformed again to the first configuration as shown in FIGS. 2, 4 and 7 so that the application member 41 has only a single linear arm 47.

The use of a wiper in a bottle is old and well known, however, a challenge with respect to applicators that are not straight is that a standard wiper is circular and will unevenly distribute product on the applicator. For example, a loop shaped applicator (as in FIG. 8) would lose most of the product on the sides of the loop, while leaving a greater quantity of product at the distal end of the loop. Moreover there is the tendency for a loop as shown in FIG. 8 to retain product within the loop itself. The present invention allows for even wiping across the applicator as it is withdrawn from a bottle through a wiper while in the configuration of FIG. 7.

The material suitable for forming the application member 41 could be any elastomeric polymer, nylon, sponge, metal etc. which possess both flexibility and elasticity. The application member 41 and/or the application elements 46 may be formed of rubber, low density polyethylene (LDPE), thermoplastic elastomers (TPE), silicone, plastic (e.g. polypropylene (PP)), fabric mesh, or any other suitable material. It is contemplated that the flexible support 42, application elements 46, and/or shank 44 may be formed from the same material or different materials, as desired. Furthermore, the application member 41 and/or the application elements 46 may be formed integrally (e.g. as unitary structure) with bristles as an injection molded unit, as a series of installed bristles (e.g., like a toothbrush), as a series of tied bristles (e.g., like a pipe cleaner), or other configuration. Further, various components of the application member 41 and/or the application elements 46 may be over-molded as a single unit. Alternatively, rather than over-molding, instead, another body comprising bristles may be over-molded to an over-molded brush and tip unit without bristles.

Further, while the application member 41 has been generally described as a bristled structure, it is contemplated that the application member 41 may take the form of other applicators including, but not limited to: a sponge, a stick, a synthetic bristle brush (e.g., plastic, silicone, latex or composites thereof), a natural bristle brush (e.g., hair, cellulose fibers, cotton, hemp, flax or composites thereof), a combination of synthetic or natural bristles, a comb, foam, silicone, a doe foot, metallic bristles, flocking, a solid applicator member (e.g., a paddle or spatula), etc. For example, an alternative application member may comprise a flexible member having flocking (or sponge, silicone, or foam, for example) on at least one surface thereof such that, when in a linear or straight configuration as in FIG. 7, the flocking (or sponge, silicone, or foam for example) extends only along one side of the transmission member 51 and, on retraction of the transmission member 51, the flexible member would assume the loop shape with the flocking (or sponge, silicone or foam, for example) would thereby be in the shape of the loop as in FIG. 8.

The materials suitable for forming the receptacle 3 could be polypropylene while the dialer 10, the sleeve 20, the transmission member 51 and the stem 30 could be formed of acrylonitrile butadiene styrene or any other suitable polymeric material. The material of the transmission member 51 could be any polymeric material like nylon, TPE, PP or could be a suitable metal. The stem 30 may be formed of polyacetal or any other suitable polymeric material. The material for forming the wiper 8 could be low-density polyethylene. The aforementioned materials for forming various parts of the package of the present disclosure are an example, however other suitable materials may also be used.

Although the above description and drawings show the package being cylindrical, the shapes and profile cross section thereof are not limited to the same.

While the foregoing is directed to embodiments of the present disclosure, other and further embodiments of the disclosure may be devised without departing from the basic scope thereof, and the scope thereof is determined by the claims that follow.

What is claimed is:

1. An adjustable applicator for applying a product to a surface, the adjustable applicator comprising:

a cap having a dialer and a sleeve, the dialer rotatably coupled to the sleeve;

a stem having an upper portion coupled to the sleeve, the stem having a cavity therein;

a transmission member having an upper end coupled to the dialer, at least a portion of the transmission member slidingly disposed with the cavity of the stem;

a flexible application member including a plurality of application elements extending from at least a portion of an outer surface thereof, the application member comprising a first end fixedly coupled to a lower end of the stem and a second end coupled to a lower end of the transmission member;

wherein rotation of the dialer relative to the sleeve in a first direction initiates a progressive modification of a shape of the application member between at least a first configuration and a second configuration;

wherein when in the first configuration, the transmission member is in an extended position thereby holding the second end of the application member spaced apart from the lower end of the stem, and when in the second configuration, the transmission member is in a retracted position thereby holding the second end of the application member in contact with the lower end of the stem.

2. The adjustable applicator of claim 1, wherein rotation of the dialer relative to the sleeve in the first direction initiates an incremental modification of the shape of the application member between the first and second configurations.

3. The adjustable applicator of claim 1, wherein when in the first configuration, a first portion of the application member extends linearly from the lower end of the stem.

4. The adjustable applicator of claim 1, wherein rotation of the dialer relative to the sleeve in a second direction opposite the first direction initiates a progressive modification of the shape of the application member between the second configuration and the first configuration.

5. The adjustable applicator of claim 1, wherein the plurality of application elements extend from only a portion of an inner surface of the application member, wherein when in the first configuration, a first portion of the inner surface of the application member faces the transmission member and is devoid of application elements.

6. The adjustable applicator of claim 1, wherein the application member has a rectangular shape with the plurality of application elements extending from less than all sides thereof.

7. An adjustable applicator for applying a product to a surface, the adjustable applicator comprising:

a cap, the cap having an upper portion and a lower portion;

a stem having an upper portion coupled to the lower portion of the cap, the stem having a cavity therein;

an application member having a first end coupled to a lower end of the stem; and a transmission member having an upper end coupled to the upper portion of the cap and a lower end coupled to a second end of the application member, the transmission member slidingly disposed within the cavity of the stem;

wherein the upper portion of the cap comprises an actuator which is actuatable to initiate a progressive modification the application member from a first configuration, in which the application member has a J shape, to a second configuration in which the application member has a closed loop shape, with a plurality of configurations therebetween.

8. The adjustable applicator of claim 7, wherein the actuator is actuatable to initiate a progressive modification of the application member from the second configuration back to the first configuration.

9. The adjustable applicator of claim 7, wherein the application member includes a plurality of application elements extending outward therefrom, wherein when in the first configuration, a first portion of an outer surface of the application member faces the transmission member and is devoid of application elements.

* * * * *